US005827395A

United States Patent [19]

Masumura et al.

[11] Patent Number: 5,827,395

[45] Date of Patent: Oct. 27, 1998

[54] POLISHING PAD USED FOR POLISHING SILICON WAFERS AND POLISHING METHOD USING THE SAME

[75] Inventors: Hisashi Masumura; Kiyoshi Suzuki; Hideo Kudo, all of Fukushima-ken, Japan

[73] Assignee: Shin-Etsu Handotai Co., Ltd., Tokyo, Japan

[21] Appl. No.: 455,519

[22] Filed: May 31, 1995

[30] Foreign Application Priority Data

Jun. 3, 1994 [JP] Japan ..... 6-122415

[51] Int. Cl.[6] ..... C23F 1/02

[52] U.S. Cl. ..... 156/345; 216/88; 216/89; 438/690; 438/691; 438/692; 438/693

[58] Field of Search ..... 156/345, 636.1, 156/645.1; 216/88, 89; 438/690, 691, 692, 693

[56] References Cited

U.S. PATENT DOCUMENTS

| | | | |
|---|---|---|---|
| 4,382,803 | 5/1983 | Allard | 51/298 |
| 4,466,218 | 8/1984 | Ottman et al. | 51/395 |
| 4,893,439 | 1/1990 | McAvoy et al. | 51/400 |
| 5,578,362 | 11/1996 | Reinhardt et al. | 428/147 |

FOREIGN PATENT DOCUMENTS

| | | |
|---|---|---|
| 0 562 919 A1 | 9/1993 | France . |
| 63144966 | 8/1986 | Japan . |
| DE-A-41 | 4/1992 | Netherlands . |
| 952762 | 3/1990 | United Kingdom . |

OTHER PUBLICATIONS

European Search Report Jun. 10, 1995.

*Primary Examiner*—Nam Nguyen
*Assistant Examiner*—Thomas W. Weingart
*Attorney, Agent, or Firm*—Nikaido Marmelstein Murray & Oram, LLP

[57] ABSTRACT

A polishing pad composed of a rigid polyurethane added with $CaCO_3$ particles is able to provide polished wafers having a surface roughness which is comparable to that attained by the conventional final polishing process. Even when polishing is achieved under a high load condition to improve the productivity, the polished wafers are free from deformation, such as concaving, and have an excellent flatness.

8 Claims, 4 Drawing Sheets

POLISHING PAD USED FOR POLISHING SILICON WAFERS AND POLISHING METHOD USING THE SAME

BACKGROUND OF THE INVENTION

1. Field of the Invention

The present invention relates to a polishing pad used for polishing silicon wafers and a polishing method using the same.

2. Description of the Related Art

Polishing pads presently used for polishing silicon wafers (hereinafter may be referred to, for brevity, as "wafers") generally comprises a velour type pad composed of a polyurethane-impregnated polyester non-woven fabric, and a foam type pad molded of a single polyurethane resin. A recent increase in the device integrality requires polished wafers whose surface is highly flat. With this requirement in view, rigid polishing pads have been used increasingly. The rigid polishing pads, however, has a drawback that they tend to lower or deteriorate the surface roughness of the polished wafers. To improve the surface roughness, polishing with the rigid polishing pad must be followed by final polishing achieved by using a soft polishing pad. The final polishing should preferably be achieved in the form of a multi-stage process which will incur an additional production cost. Another problem is that even if the wafers have already acquired a sufficient flatness through the preceding polishing using the rigid polishing pad, the following final polishing process may bring about wafer shape deformation. Furthermore, when polishing is achieved under a high pressure or load condition using the rigid polishing pad, the polished wafers are thinned at a central portion to assume a concave shape and hence resulting flatness is considerably low. This problem does not occur when the pressure or load on the rigid polyurethane pad is low. However, under such low pressure or load condition, the productivity is significantly lowered due to a low polishing rate available.

SUMMARY OF THE INVENTION

The present inventors found by extended researches that all of the foregoing problems could be solved by a polishing pad of rigid polyurethane added with particles of $CaCO_3$ (calcium carbonate).

It is an object of the present invention to provide a rigid polishing pad which is able to provide a polished silicon wafer not only having a surface roughness comparable to that obtained by final polishing, but also having an excellent flatness free from deformation such as concaving.

Another object of the present invention is to provide a silicon-wafer polishing method using such rigid polishing pad for enabling single-stage polishing of the silicon wafer.

A polishing pad of this invention for polishing a silicon wafer comprises a pad of rigid polyurethane added with particles of $CaCO_3$.

The polyurethane pad has a JIS-A hardness in the range of from 60 to 100, preferably from 70 to 100, and optimally from 85 to 95.

The amount of the $CaCO_3$ particles added to the polyurethane pad is in the range of from 1 to 10 percent by weight, preferably from 2 to 8 percent by weight, and optimally from 3 to 6 percent by weight.

The $CaCO_3$ particles have an average particle diameter or size in the range of from 0.01 to 10 $\mu$m, preferably from 0.01 to 1 $\mu$m, and optimally from 0.1 to 1 $\mu$m.

A silicon-wafer polishing method of this invention is characterized by using the polishing pad of the type specified above.

The above and other objects, features and advantages of the present invention will become manifest to those versed in the art upon making reference to the detailed description and the accompanying sheets of drawings in which a preferred structural embodiment incorporating the principle of the present invention is shown by way of illustrative example.

DETAILED DESCRIPTION

The present invention will be described below in greater detail by way of the following examples which should be construed as illustrative rather than restrictive.

Figure 7:
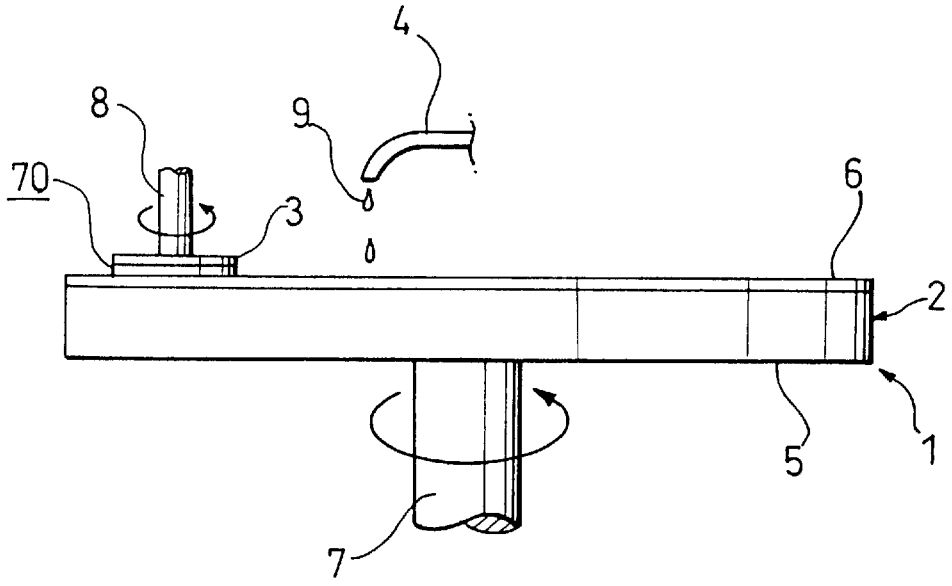
FIG. 7 is an elevational view of an apparatus for polishing a wafer.

FIG. 7 shows an apparatus 1 for polishing a single crystal silicon wafer 70, to carry out polishing processes in Examples 1–2.

In FIG. 7, the apparatus 1 comprises a rotary table assembly 2, a rotary wafer carrier 3, and a polishing agent supplying member 4. The rotary table assembly 2 comprises a rotary table 5 and a polishing pad 6 adhered on the upper surface of the rotary table 5. The rotary table 5 can rotate on a shaft 7 at a predetermined rotation speed by a driving device such as a motor. The polishing pad 6 comprises a polyurethane foam added with particles of $CaCO_3$. The rotary wafer carrier 3 is for holding to carry the wafer 70 on the polishing pad 6 of the rotary table assembly 2 so that the surface of the wafer 70 faces to the polishing pad 6. The wafer carrier 3 can rotate on a shaft 8 at a predetermined rotation speed and horizontally move on the polishing pad 6 by an appropriate driving device such as a motor. During operation of the apparatus 1, the wafer 70 held by the wafer carrier 3 is in contact with the polishing pad 6 and proper polishing loads are applied to the wafer 70 in a downward direction through the shaft 8 and the wafer carrier 3. The polishing agent supplying member 4 is for supplying a polishing agent 9 on the polishing pad 6 to supply it between the wafer 70 and the polishing pad 6. The polishing agent 9 has an appropriate pH value and includes water and abrasive grains.

EXAMPLE 1

Condition:

Sample wafer: Czochralski-grown p-type, <100>-oriented, 150-mm-diameter, single crystal silicon wafer Polishing pad: Polyurethane foam (JIS-A hardness=86)

$CaCO_3$ particles added to the polishing pad: the amount added=3.5 wt %, average particle size=0.1 $\mu$m (arithmetical average of the length and the breadth of particles obtained by direct observation method)

Polishing agent: AJ-1325 (tradename for a polishing agent of colloidal silica manufactured by Nissan Chemical Industries, Ltd.)

Polishing load: 400 g/cm$^2$

Polishing time: 10 min.

Figure 1:
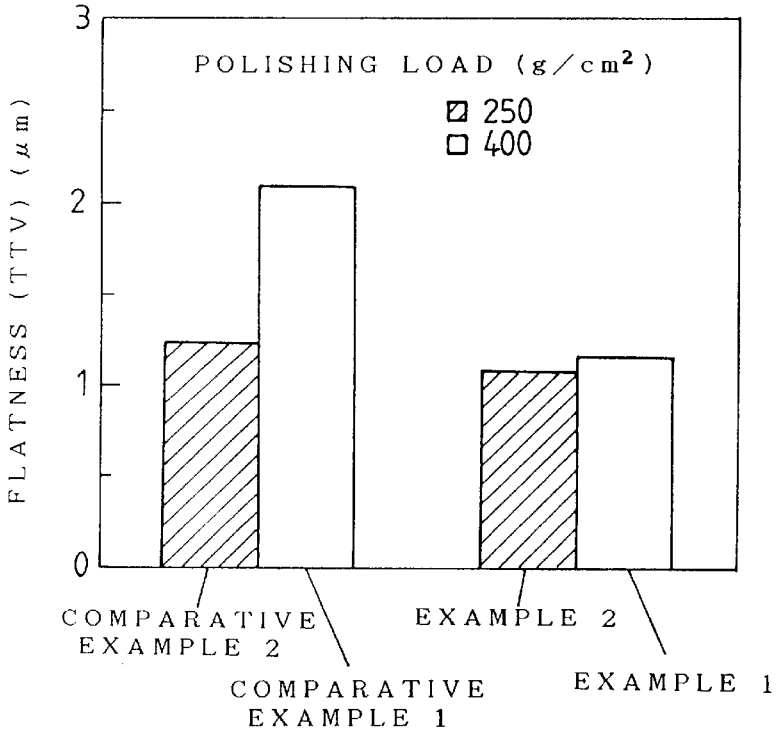
FIG. 1 is a graph showing the flatness of four different wafers polished according to Examples 1 and 2 and Comparative Examples 1 and 2, respectively.
Figure 2:
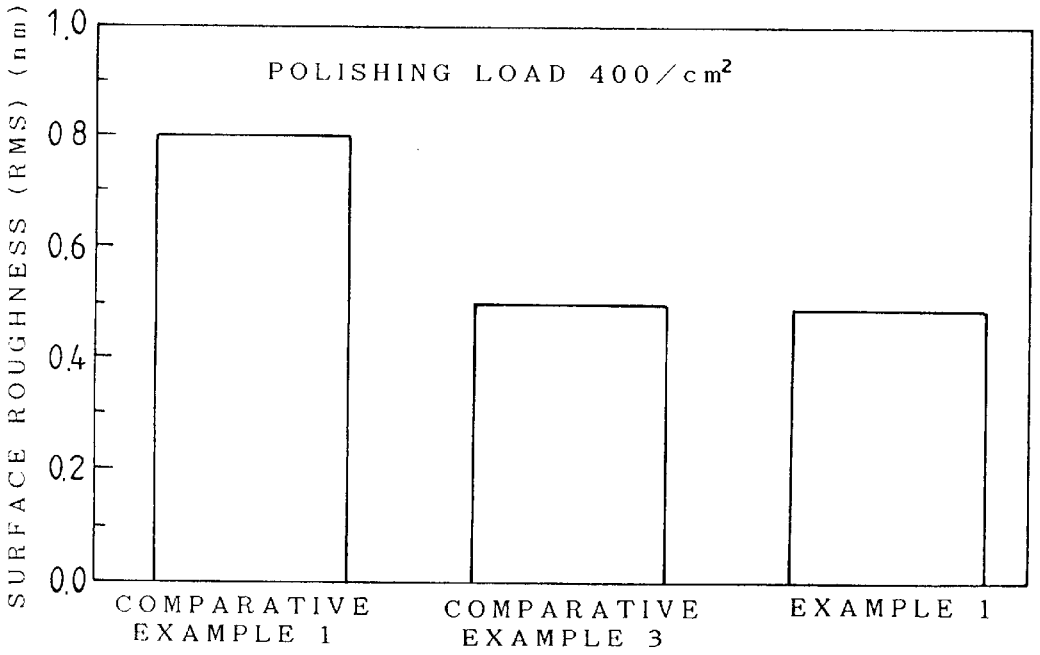
FIG. 2 is a graph showing the surface roughness of the wafers polished according to Example 1 and Comparative Examples 1 and 3.
Figure 3:
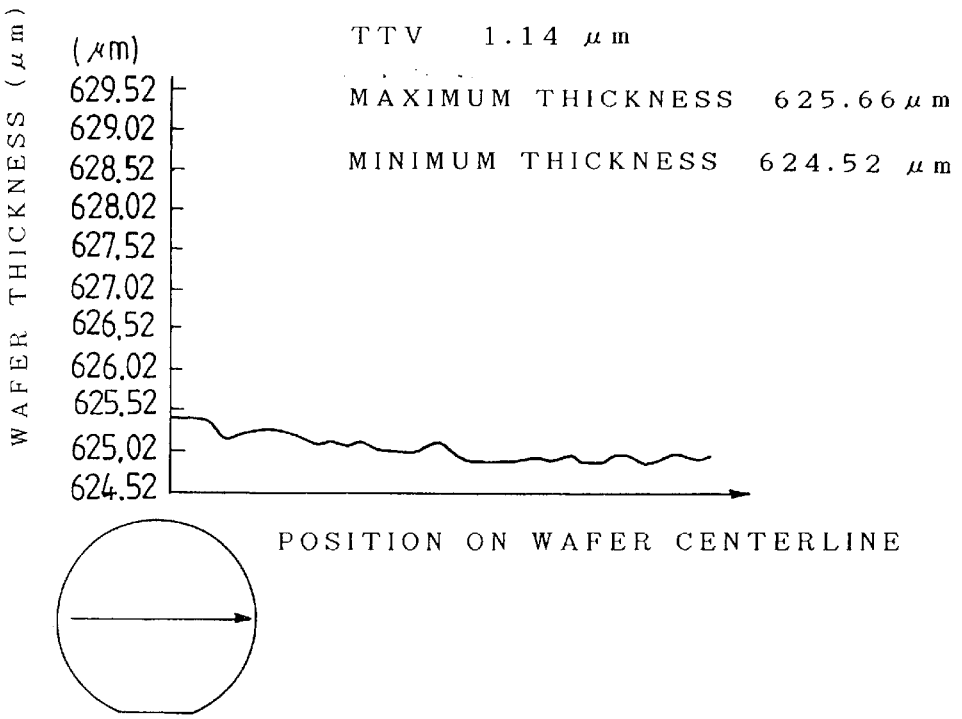
FIG. 3 is a graph showing a cross-sectional shape of the polished wafer according to Example 1.

Under the condition specified above, the sample wafer was polished with the apparatus 1 shown in FIG. 7. Then, surface flatness (TTV=Total Thickness Variation) of the polished wafer was measured by means of an ADE Microscan 8300 (manufactured by ADE, Inc.). The results of the measurement are shown in FIG. 1. The flatness (TTV) is defined as the difference between the maximum and minimum values of thickness encountered in the polished wafer. Using an optical interference roughness tester (WYKOTOPO-3D, 250 $\mu$m□, manufactured by WYKO, Inc.), a measurement was made for surface roughness of the polished wafer with the results shown in FIG. 2. A further measurement was carried out with the use of the ADE Microscan 8300 so as to determine the cross-sectional shape of the polished wafer. The results of the measurement are shown in FIG. 3. In FIG. 3, the axis of ordinate indicates thickness of the wafer, and the axis of abscissa indicates positions on a centerline of the wafer within a flatness quality area excluding a peripheral edge of 3 mm in width.

EXAMPLE 2

Figure 4:
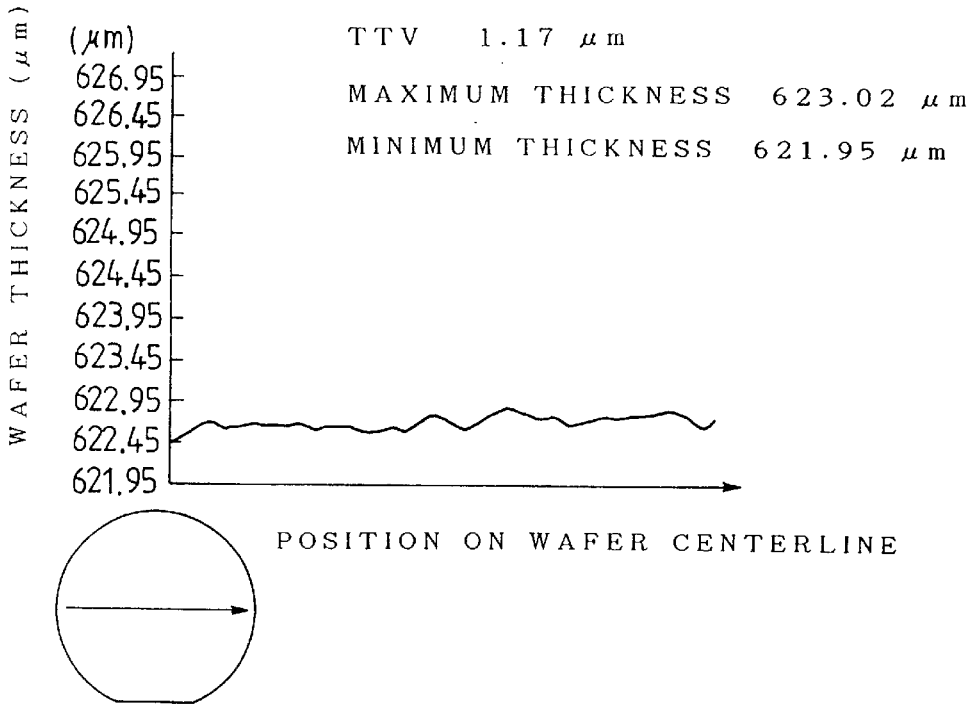
FIG. 4 is a graph showing a cross-sectional shape of the polished wafer according to Example 2.

Example 1 was repeated with the difference that the polishing load was changed from 400 g/cm$^2$ to 250 g/cm$^2$, and the surface roughness measurement was omitted. The results of the flatness measurement (TTV) are also shown in FIG. 1. The results of the cross section measurement are shown in FIG. 4. In FIG. 4, the axis of ordinate and the axis of abscissa have the same meaning as those shown in FIG. 3.

COMPARATIVE EXAMPLE 1

Figure 5:
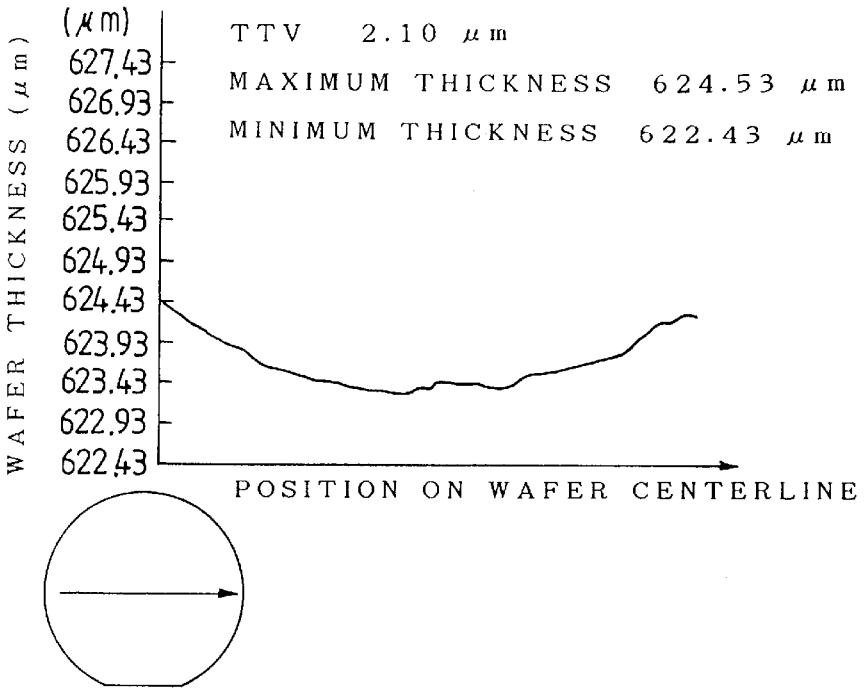
FIG. 5 is a graph showing a cross-sectional shape of the polished wafer according to Comparative Example 1.

Example 1 was repeated by using a conventional polishing pad composed of a polyurethane foam having no $CaCO_3$ particles added. The results of the flatness measurement, and the results of the surface roughness measurement are shown in FIGS. 1 and 2, respectively. The results of the cross section measurement are shown in FIG. 5 whose axes of ordinate and abscissa have the same meaning as those shown in FIG. 3.

COMPARATIVE EXAMPLE 2

Figure 6:
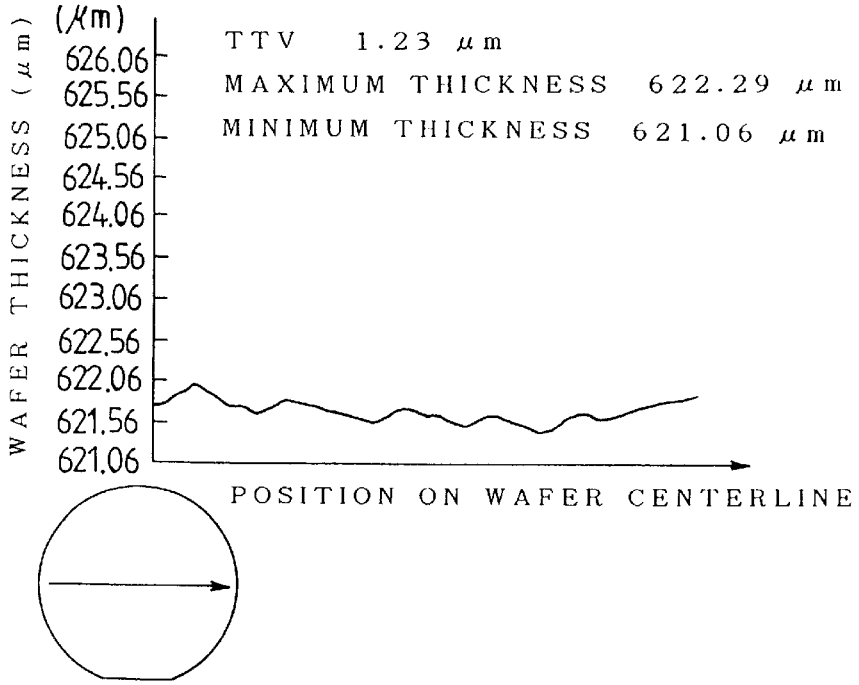
FIG. 6 is a graph showing a cross-sectional shape of the polished wafer according to Comparative Example 2.

Example 2 was repeated with the exception that the $CaCO_3$-added polyurethane foam polishing pad was replaced by a conventional polyurethane foam polishing pad made without $CaCO_3$ particles added. The results of the flatness measurement are shown in FIG. 1. The results of the cross section measurement are shown in FIG. 6 whose axes of ordinate and abscissa have the same meaning as those shown in FIG. 3.

COMPARATIVE EXAMPLE 3

The polished wafer of Comparative Example 1 was subjected to final polishing achieved under the following condition with the apparatus 1 shown in FIG. 7.

Polishing pad: soft polyurethane pad (JIS-A hardness=66)

$CaCO_3$ particles added to the polishing pad: not used

Polishing agent: AJ-1325 as specified above

Polishing load: 150 g/cm$^2$

Polishing time: 10 min.

After the final polishing, the surface roughness of the wafer was measured with the results shown in FIG. 2 along with the results of Example 1 and the results of Comparative Example 1.

It appears clear from FIG. 1 that the polished surface of a wafer polished by the polishing pad of this invention under a high load condition (400 g/cm$^2$) of Example 1 has a flatness which is comparable to that obtained by the conventional rigid polishing pad under the low load condition (250 g/cm$^2$) of Comparative Example 2. The surface roughness of the wafer polished by the polishing pad of this invention under the high load condition of Example 1 is considerably lower than that attained by the first polishing stage achieved under the high load condition (Comparative Example 1) by using the conventional rigid polishing pad, and is substantially the same as that attained by the second or final polishing stage achieved under the low load condition (Comparative Example 2) by using the conventional polishing pad. In sum, the surface roughness attained by the present invention is comparable to that attained by the final polishing process. Furthermore, the conventional polishing achieved under the high load condition (400 g/cm$^2$) tends to deform the polished wafer surface into a concave shape, as shown in FIG. 5. As is apparent from FIGS. 3 and 4, the present polishing processes, as against the conventional one, are completely free from the concave wafer-deformation problem.

It is apparent from the foregoing description that the present invention is able to provide, through a single-stage polishing process, a polished wafer having a surface roughness and a flatness which are comparable to those attained by the conventional final polishing process. The conventional final polishing process can, therefore, be dispensed with, so that the overall polishing process of this present invention is sufficiently simple.

Obviously, various minor changes and modifications of the present invention are possible in the light of the above teaching. It is therefore to be understood that within the scope of the appended claims the invention may be practiced otherwise than as specifically described.

What is claimed is:

1. A polishing pad for polishing a silicon wafer, comprising a pad of rigid polyurethane added with particles of $CaCO_3$, said rigid polyurethane pad having a JIS-A hardness in the range of from 60 to 100.

2. A polishing pad according to claim 1, wherein the amount of said $CaCO_3$ particles added to said rigid polyurethane pad is in the range of from 1 to 10 percent by weight.

3. A polishing pad according to claim 2, wherein said $CaCO_3$ particles have an average particle size of from 0.01 to 10 $\mu$m.

4. A method of polishing a silicon wafer characterized by using the polishing pad of claim 3.

5. A method of polishing a silicon wafer characterized by using the polishing pad of claim 2.

6. A polishing pad according to claim 1, wherein said $CaCO_3$ particles have an average particle size of from 0.01 to 10 $\mu$m.

7. A method of polishing a silicon wafer characterized by using the polishing pad of claim 6.

8. A method of polishing a silicon wafer characterized by using the polishing pad of claim 1.

* * * * *